US007097035B2

(12) United States Patent
Agakanian

(10) Patent No.: US 7,097,035 B2
(45) Date of Patent: Aug. 29, 2006

(54) INTERCONNECTABLE DISPLAY PACKAGES AND SHIPPING SYSTEM

(75) Inventor: Armik Agakanian, La Crescenta, CA (US)

(73) Assignee: Quetico LLC, Chino, CA (US)

( * ) Notice: Subject to any disclaimer, the term of this patent is extended or adjusted under 35 U.S.C. 154(b) by 253 days.

(21) Appl. No.: 10/712,278

(22) Filed: Nov. 12, 2003

(65) Prior Publication Data

US 2005/0098467 A1 May 12, 2005

(51) Int. Cl.
*B65D 73/00* (2006.01)

(52) U.S. Cl. ..... 206/467; 206/511

(58) Field of Classification Search ..... 206/467, 206/468, 470, 471, 561, 562, 564, 508, 509, 206/511, 512

See application file for complete search history.

(56) References Cited

U.S. PATENT DOCUMENTS

| | | | | | |
|---|---|---|---|---|---|
| 2,960,134 | A | | 11/1960 | Fornas | |
| 3,283,943 | A | | 11/1966 | Cargnelutti | |
| 3,392,877 | A | | 7/1968 | Sanders | |
| 3,856,178 | A | | 12/1974 | Norgaard | |
| 4,700,842 | A | | 10/1987 | Grusin | |
| 4,703,857 | A | | 11/1987 | Jahnen | |
| 5,281,400 | A | * | 1/1994 | Berry, Jr. | 422/295 |
| 5,318,182 | A | | 6/1994 | Thorud et al. | |
| D353,092 | S | * | 12/1994 | Green | D9/732 |
| 5,411,140 | A | * | 5/1995 | Byer | 206/504 |
| 5,503,275 | A | | 4/1996 | Fesquet | |
| 5,573,117 | A | | 11/1996 | Adams | |
| 5,699,925 | A | | 12/1997 | Petruzzi | |
| D412,631 | S | | 8/1999 | Green | |
| 5,964,350 | A | * | 10/1999 | LaMarche et al. | 206/470 |
| 5,979,662 | A | | 11/1999 | Green | |
| 6,050,420 | A | | 4/2000 | Green | |
| 6,152,305 | A | | 11/2000 | Green | |
| 6,196,404 | B1 | * | 3/2001 | Chen | 220/4.21 |
| 6,367,632 | B1 | | 4/2002 | Green | |
| 6,394,274 | B1 | | 5/2002 | Cheeseman | |
| 6,427,842 | B1 | | 8/2002 | Green | |

* cited by examiner

*Primary Examiner*—Shian T. Luong
(74) *Attorney, Agent, or Firm*—Christie, Parker & Hale, LLP

(57) ABSTRACT

A display package for merchandising articles of commerce with first and second package portions. The first package portion has side walls with outwardly extending tabs, a first interface region, and a back wall with an outwardly extending first cavity portion, with the first cavity portion having a first engagement formed thereon. The second package portion has side walls, a second interface region, and a front wall with an outwardly extending second cavity portion with a second engagement formed thereon. The first and second package portions fit together along their interface regions. A plurality of display packages can be interconnected by engaging the first engagement of one display package with the second engagement of an adjacent display package. When interconnected, the tabs of one display package will be positioned next to the side walls of an adjacent display package thereby forming a space between the adjacent display packages. Additional outwardly extended tabs located along a base wall provide a stabilizing function enabling the packages to stand separately and unsupported.

6 Claims, 9 Drawing Sheets

INTERCONNECTABLE DISPLAY PACKAGES AND SHIPPING SYSTEM

CROSS REFERENCE TO RELATED APPLICATION

The present application is related to co-pending application entitled DISPLAY PACKAGE AND SHIPPING SYSTEM, U.S. patent application Ser. No. 10,705,338 filed Nov. 10, 2003, the entire disclosure of which is incorporated herein by reference.

Please delete the cross reference to the co-pending application U.S. patent application Ser. No. 10/705,338 filed Nov. 10, 2003, which is now abandoned.

BACKGROUND OF THE INVENTION

The present invention relates to a display package for displaying merchandise in a commercial setting, and to a system for interconnecting a plurality of display packages together to make the packages suitable for shipment from manufacturer to retailer and equally suited for immediate display on pallets and the like in the same configuration. The invention also relates to a system for shipping and displaying products that are packaged in display packages according to the present invention in a blister pack or clamshell package form.

Many products are sold in blister packages or clamshell packages. In blister packages, the article is placed on a piece of cardboard and then covered by a plastic bubble that is sized to retain and reveal the item which is attached to the cardboard. Some blister packages use a plastic back rather than cardboard. Clamshell packages are similar to blister packages but instead of having a plastic bubble affixed to a cardboard or other backing, clamshell packages have two portions that are designed to hold the merchandise, literature, etc. within a cavity or cavities therein. The clamshell packages can be formed into a single unit with a hinge, or they can have two separate halves which are attached together, such as by heat welding, staples, RF sealing, UV sealing, etc. Typically, groups of blister packages and clamshell packages are shipped to the point of sale in corrugated trays that are in turn placed in larger shipping containers or on pallets. There the blister packages or clamshell packages are removed from their shipping configuration and displayed for sale in their trays and pallets or on shelves, counters, tables, racks and hanging brackets.

Many retail stores are now selling articles directly from their shipping containers or pallets. This permits retailers to reduce their labor costs because they no longer need to remove the products from the shipping container, and then place them on display racks. A preferred practice is to remove or cut away a portion of the shipping container, leaving the product to be displayed in the remaining portion of the shipping container. Preferably, a sufficient part of the shipping container is cut away so that the products can easily be viewed by the passing customer.

However, because of their shape and the location of their center of gravity, most blister packages and clamshell packages have a tendency to fall over when placed in a standalone upright position. Consequently in order for blister packages to be displayed in a shipping container or on a pallet, it is necessary to provide some form of support structure to hold the blister packages in an upright display position. A number of systems have been utilized, most of which require some form of plastic or corrugated tray into which display package are placed in one or more rows. The tray has slots into which the opposite edges of the blister pack or clamshell pack are fitted.

It would be desirable to have display packages and a system that does not rely on such trays. It would also be useful to have display packaging system which gives positive visual cues to both the customer and vendor as to the number of packaged items being handled. A display package which is sufficiently stabilized to stand alone on one of its sides is also desirable.

Moreover, while it is desirable that the interconnection between adjacent display packages be maintained during shipping and store display, it is important for a purchaser to be able to easily remove a desired number of display packages from the group of interconnected display packages without disrupting the group of interconnected display packages remaining at the display location.

SUMMARY OF THE INVENTION

The present invention provides a display package for merchandising articles which comprises a package having a front portion and a rear portion which fit together. The front portion has a front cavity and the rear portion has a rear cavity, such that when the front portion and rear portion are put together the front and rear cavities define a space therein for holding the merchandised articles. In a preferred form, a portion of the outer surface of the front cavity of one display package is designed and configured to interface or connect with a portion of the outer surface of the rear cavity of an adjacent display package, with the established interconnection thus acting to retain adjacent display packages together. The display packages can optionally have tabs formed on at least one of the front portion and a rear portion that will stabilize the interconnected display packages and prevent them from swaying and overly flexing when display packages are separated from each other.

The display packages can optionally have stabilizing feet located at the bottom of one or more of the front portion and rear portion to further stabilize the display package to help prevent them from tipping over, either individually or when joined together.

In one exemplary embodiment of the present invention, there is provided a display package for merchandising articles of commerce, comprising:

- a first package portion having a first interface region, a back wall, and a first cavity portion extending from the back wall, the first cavity portion having a first engagement means; and
- a second package portion having a second interface region, a front wall, and a second cavity portion extending from the front wall, the second cavity portion having a second engagement means.

In another exemplary embodiment, there is provided a system of interconnectable display packages for merchandising articles of commerce, comprising a plurality of display packages, each display package comprising:

- a first package portion having a first interface region, a back wall, and a first cavity portion extending from the back wall, the first cavity portion having a first engagement means; and
- a second package portion having a second interface region, a front wall, and a second cavity portion extending from the front fall, the second cavity portion having a second engagement means, wherein the first package portion is adapted to engaged or interface with the second package portion with the first interface region interfacing with the second interface region, and wherein the first engagement means of the first package portion of one display package is adapted to engage or interface with the second engagement means of the second package portion of another display package.

In yet another exemplary embodiment of the invention there is provided interconnectable display packages for merchandising articles of commerce, comprising:

a first package portion having side walls with tabs formed thereon which extend outwardly from a top edge of the rest of the side walls, a first interface region around the side walls, and a back wall from which extends a first cavity portion, the first cavity portion having a first engagement means;

a second package portion having side walls, a second interface region around the side walls, and a front wall from which extends a second cavity portion, the second cavity portion having a second engagement means formed thereon, wherein the first package portion is adapted to fit together with the second package portion with the first interface region interfacing with the second interface region, wherein the first and second cavity portions form a combined cavity portion, and wherein the first engagement means of the first package portion of one display package is adapted to engage or interface with the second engagement means of the second package portion of another display package, with the tabs of one display package being located next to the side walls of an adjacent display package, thereby forming a space between the adjacent display packages.

The configuration of the display package is such that a plurality of packages can be engaged or interfaced in self-supporting rows without the need for slotted trays for support. To further augment the system, two or more rows of display packages can be placed side by side, and comprise a first layer of display packages which is then placed on a pallet or other display surface. Second, third and additional layers can be stacked on top of each other, separated by a sheet of cardboard or the like. Once the pallet assembly is complete, it is shrouded with plastic wrap film or other restraining media around the entire assembly, including the pallet and the entire assembly is ready for shipment. When received at a commercial or retail outlet, the pallet borne assembly can be placed directly on the floor of the outlet and the pallet wrap or shipping shroud is removed from the assembly. The display packages are then immediately available and ready for display to customers. Removal of the first pack from the top layer and first row leaves the other packages in the row intact so that the packages can be removed one by one, while the remaining display packages remain in self supporting interfaced or interconnected relationship maintaining the integrity of the packages and pallet display.

BRIEF DESCRIPTION OF THE DRAWINGS

The invention may more readily understood by referring to the accompanying drawing, as follows.

DETAILED DESCRIPTION OF THE INVENTION

Figure 1:
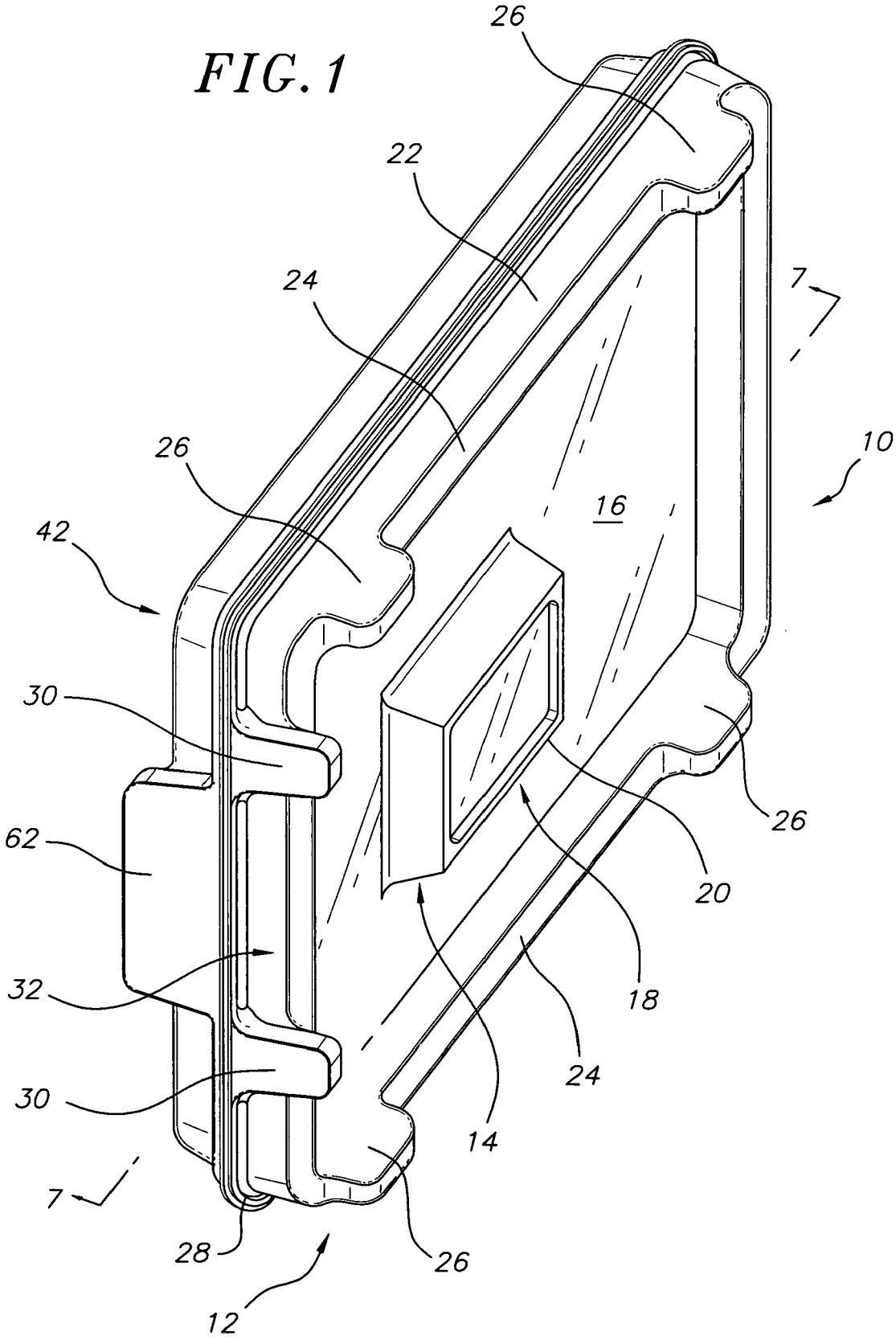
FIG. 1 is a isometric back view of an exemplary display package according to the present invention.
Figure 2:
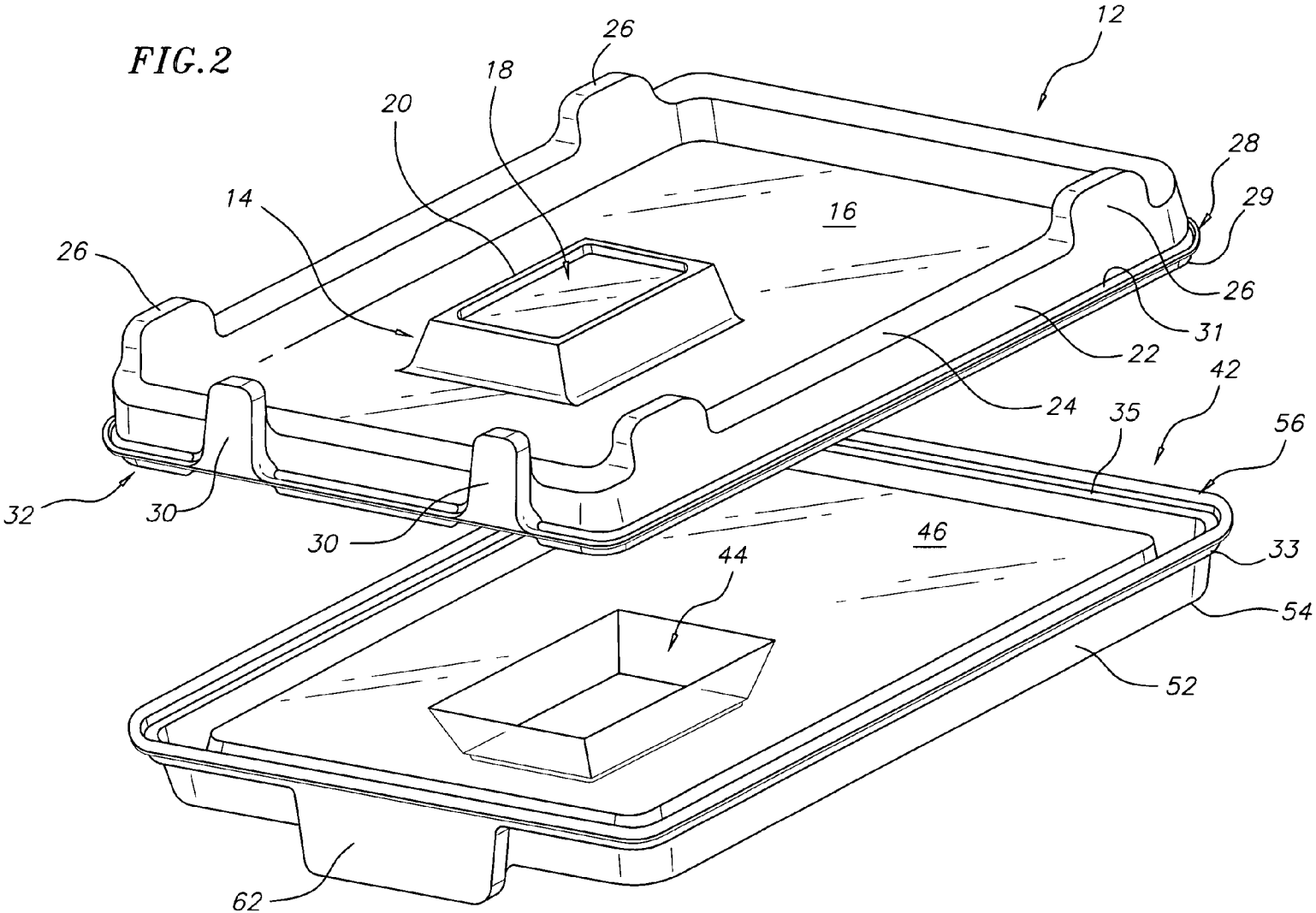
FIG. 2 is an exploded isometric view of the exemplary display package of FIG. 1 showing the front and rear portions.
Figure 3:
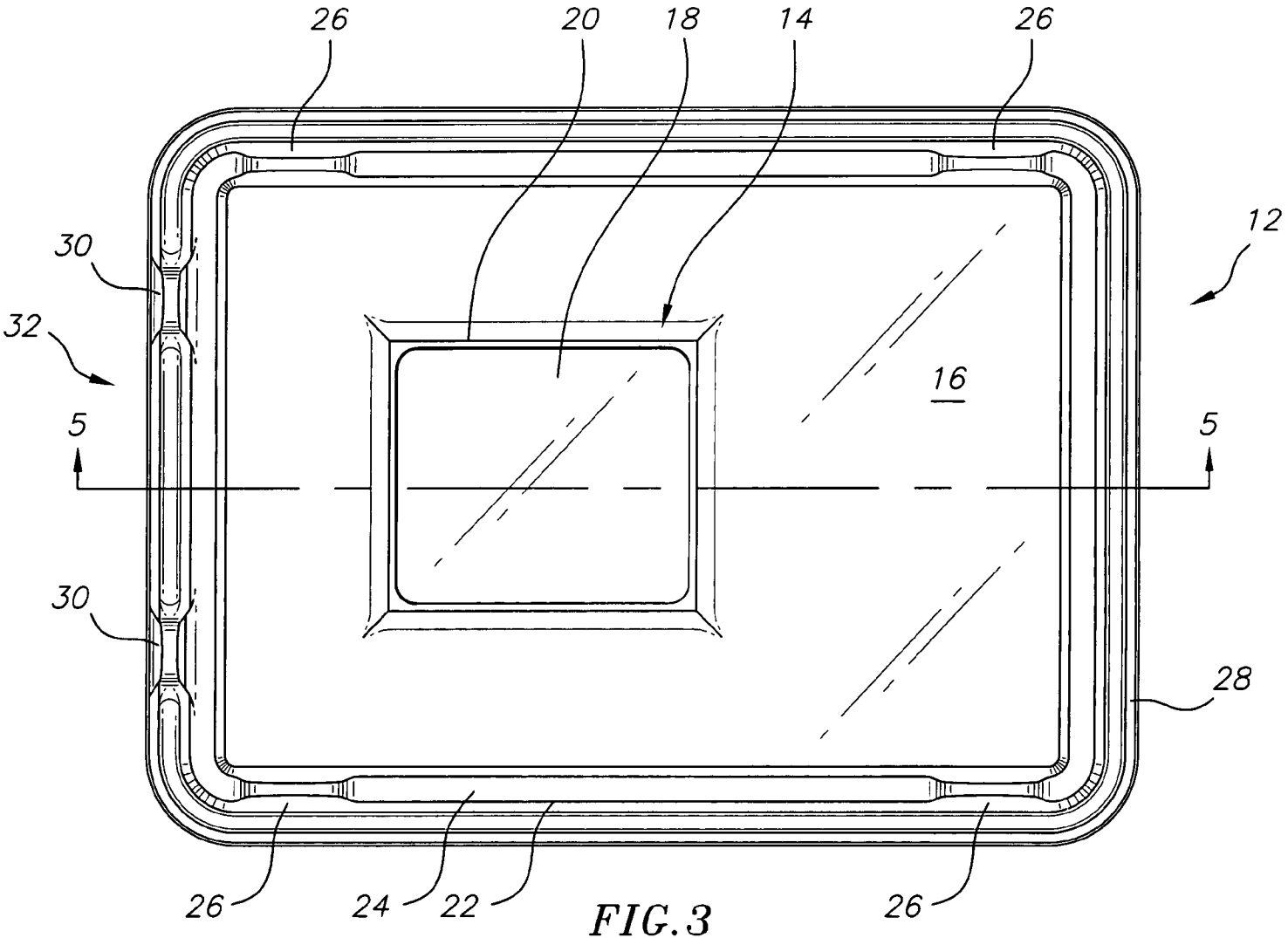
FIG. 3 is a plan view of the exterior surface of the rear portion of the exemplary display package of FIG. 1.
Figure 4:
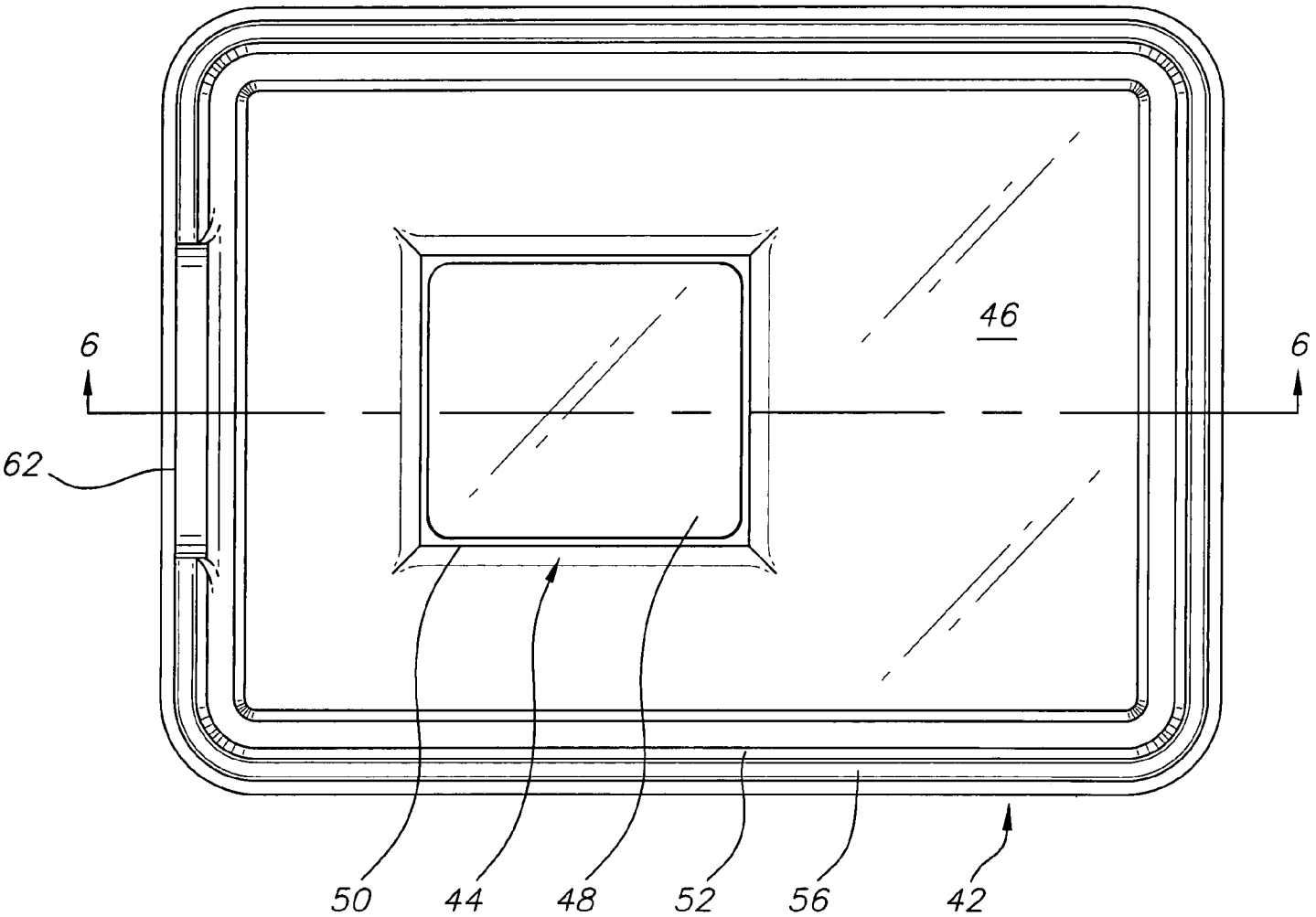
FIG. 4 is a plan view of the interior side of the front portion of the exemplary display package of FIG. 1.
Figure 5:
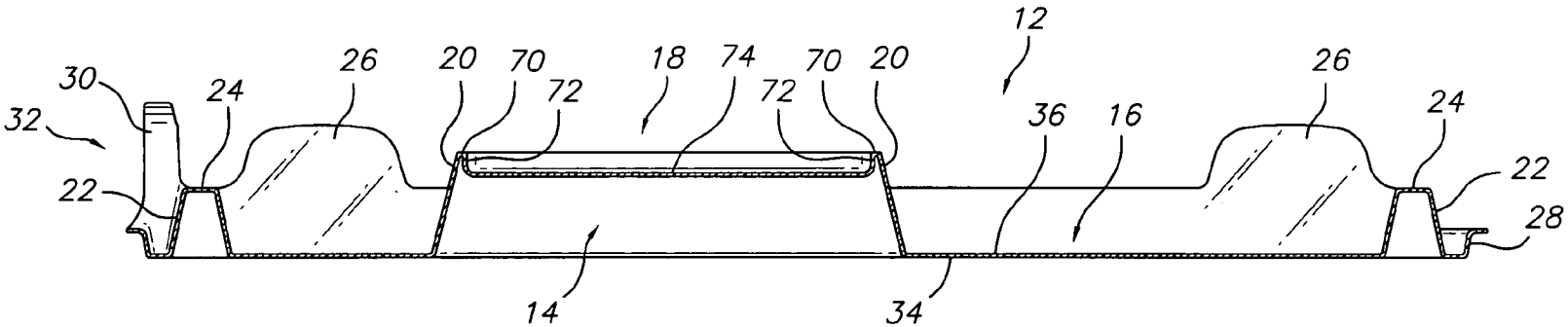
FIG. 5 is a cross-section view along view lines 5—5 of the rear portion of exemplary display package of FIG. 3.
Figure 6:
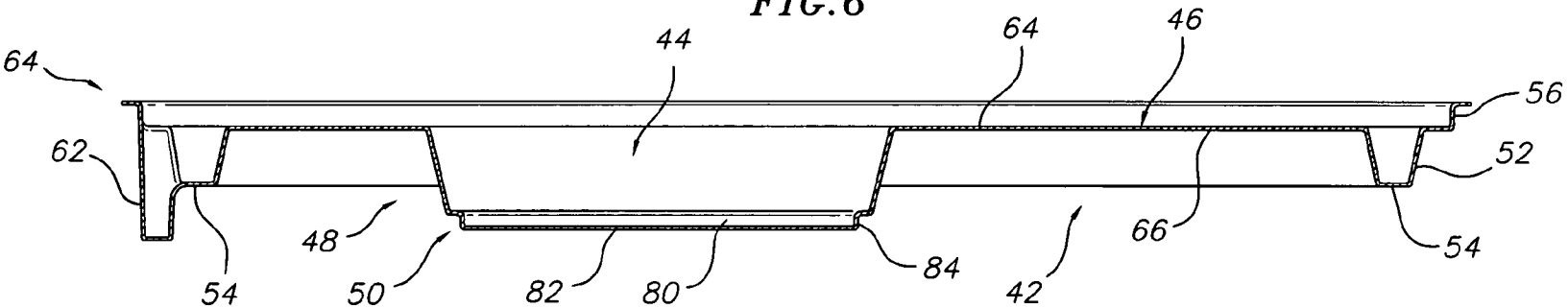
FIG. 6 is a cross-section view along view lines 6—6 of the front portion of exemplary display package of FIG. 4.
Figure 7:
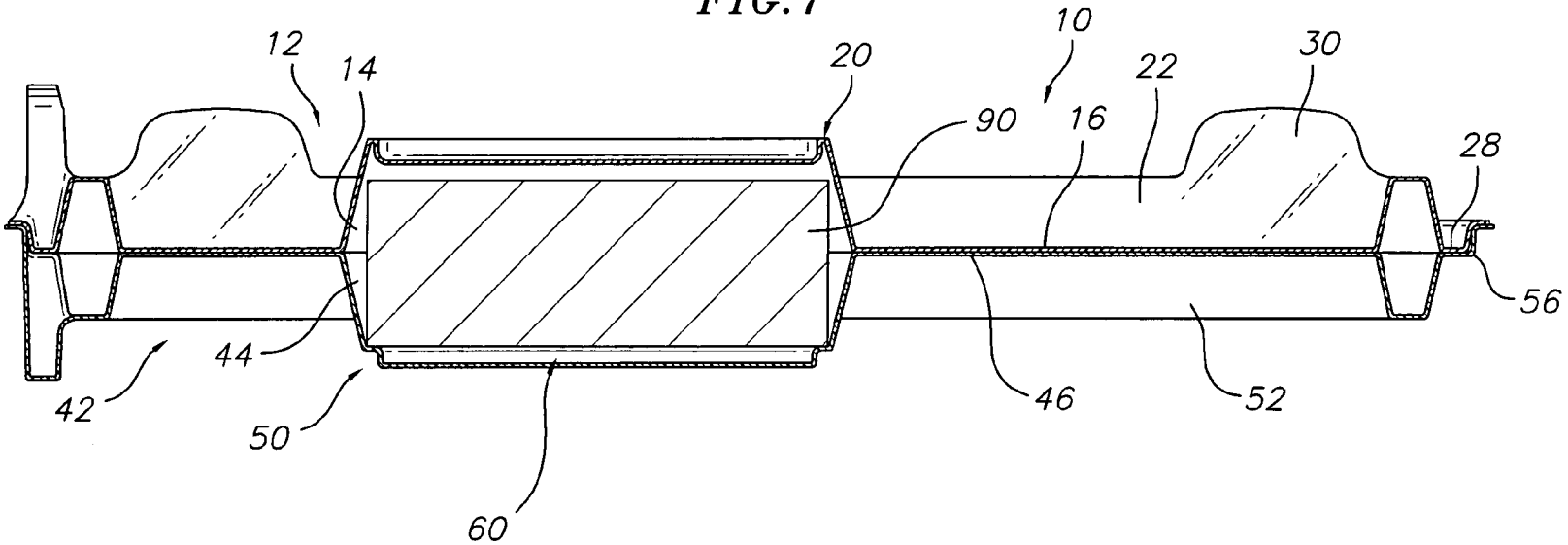
FIG. 7 is a cross-section view along view lines 7—7 of the exemplary display package of FIG. 1.

Referring to FIGS. 1–6, an exemplary display package 10 of the invention is shown, with FIG. 1 being an isometric back view of an exemplary display package, FIG. 2 being an exploded isometric view, FIG. 3 being a plan view of the exterior surface of the rear package portion 12, FIG. 4 being a plan view of the interior side of the front package portion 42, FIG. 5 being a cross-section view along view lines 5-5 of FIG. 3, and FIG. 6 being a cross-section view along view lines 6–6 of FIG. 4. Display package 10 has a first (rear) package portion 12 with a first cavity portion 14 that extends outwardly from a back wall 16. First cavity portion 14 has an upper region 18 with a first engagement means 20 formed thereon. A side wall 22 extends above back wall 16 and around a perimeter of front package portion 12 and has a upper edge 24. Optional separating tabs 26 (which can be formed as part of wall 22) extend above upper edge 24 of wall 22. Alternately, wall 22 can have higher areas and lower areas. A first interface region 28 is formed around wall 22 comprising a ridge 29 and a channel 31. Optional stabilizing feet 30 (or a single foot) can be located at a bottom end 32 of front portion 12, and extend outwardly beyond upper edge 24 of wall 22. A second (front) package portion 42 with a second cavity portion 44 that extends outwardly from a front wall 46 is provided. Second cavity portion 44 has an upper region 48 with a second engagement means 50 formed thereon. A side wall 52 extends around a perimeter of front portion 42 and has a upper edge 54. A second interface region 56 is formed around side wall 52 comprising a ridge 33 and a shelf 35. First interface region 28 and second interface region 56 are adapted to engage with each other by means of seating ridge 29 on shelf 35 to permit first package portion 12 and second package portion 42 to close together and retain merchandise 90 within a combined cavity portion 60 of first cavity portion 14 aligned with second cavity portion 44 as shown in FIG. 7. An optional stabilizing foot 62 (or multiple feet, not shown) can be located at a bottom end 64 of second portion package 42, and preferably will extend beyond upper edge 54 of side wall 52. The engagement means can be attached to the package portions by glue or other fastening means, or preferably may be integrally formed together with the packaging.

Referring to FIG. 5, rear wall 16 of first package portion 12 has an inner surface 34 and an outer surface 36. First engagement means 20 at upper region 18 of first cavity portion 14 can comprise a lip 20 with an upper edge 70 and an inside surface 72. Surrounded by lip 20 is a lower surface 74 which is below upper edge 72 of lip 20. At least portions of inside surface 72 can be slanted inwardly (see FIG. 9A), and/or have grooves or dimples (FIG. 9B), or protrusions (FIG. C) formed thereon, the purpose of which is described below.

Referring to FIG. 6, front wall 46 of second package portion 42 has an inner surface 64 and an outer surface 66. Second engagement means 50 at upper region 48 of second cavity portion 44 can comprise a raised area 80 with an upper wall 82 and upper rim 84. At least portions of upper rim 84 can be slanted outwardly (see FIG. 9A), and/or have an outer bead (FIG. 9B), grooves or dimples (FIG. 9C) formed thereon, the purpose of which is described below.

Figure 8:
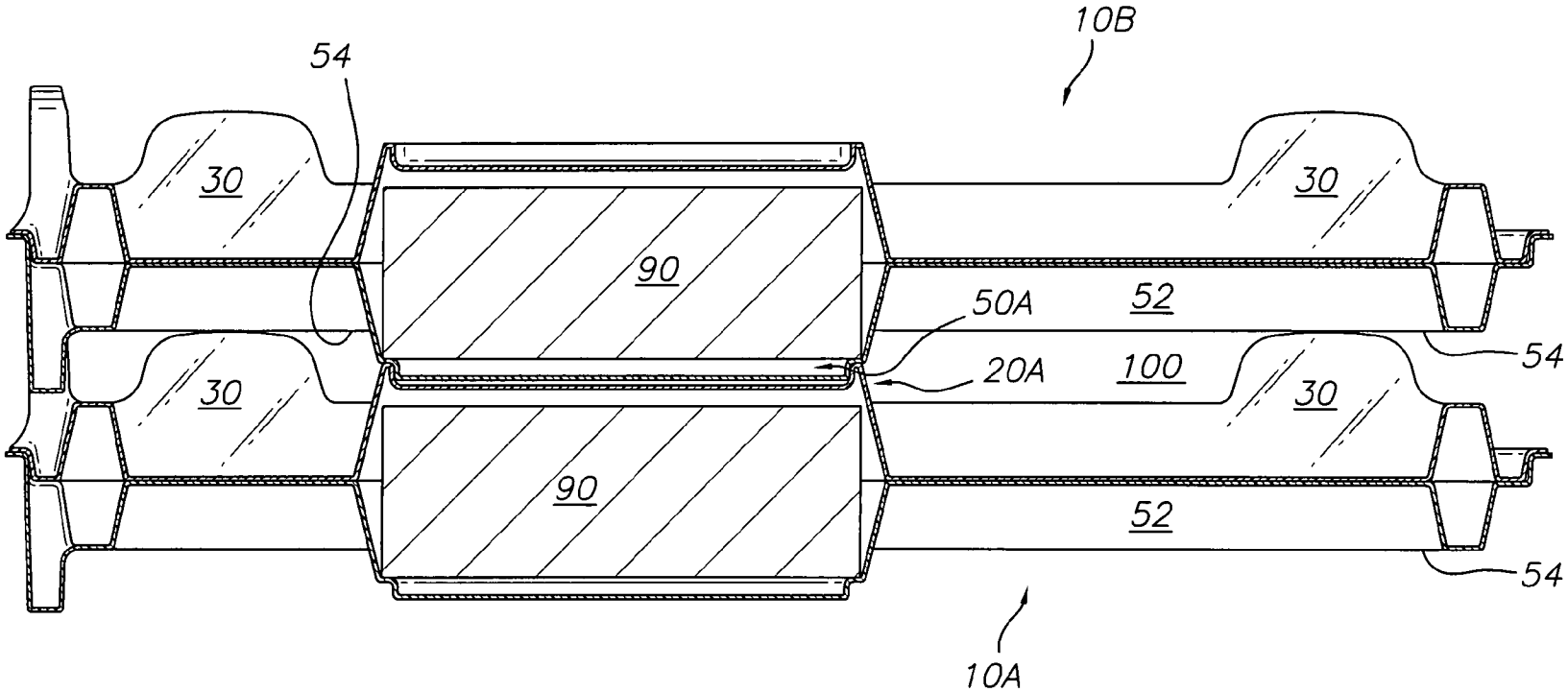
FIG. 8 is a cross-section view as in FIG. 7 showing the two exemplary display package of FIG. 1. attached together.
Figure 10:
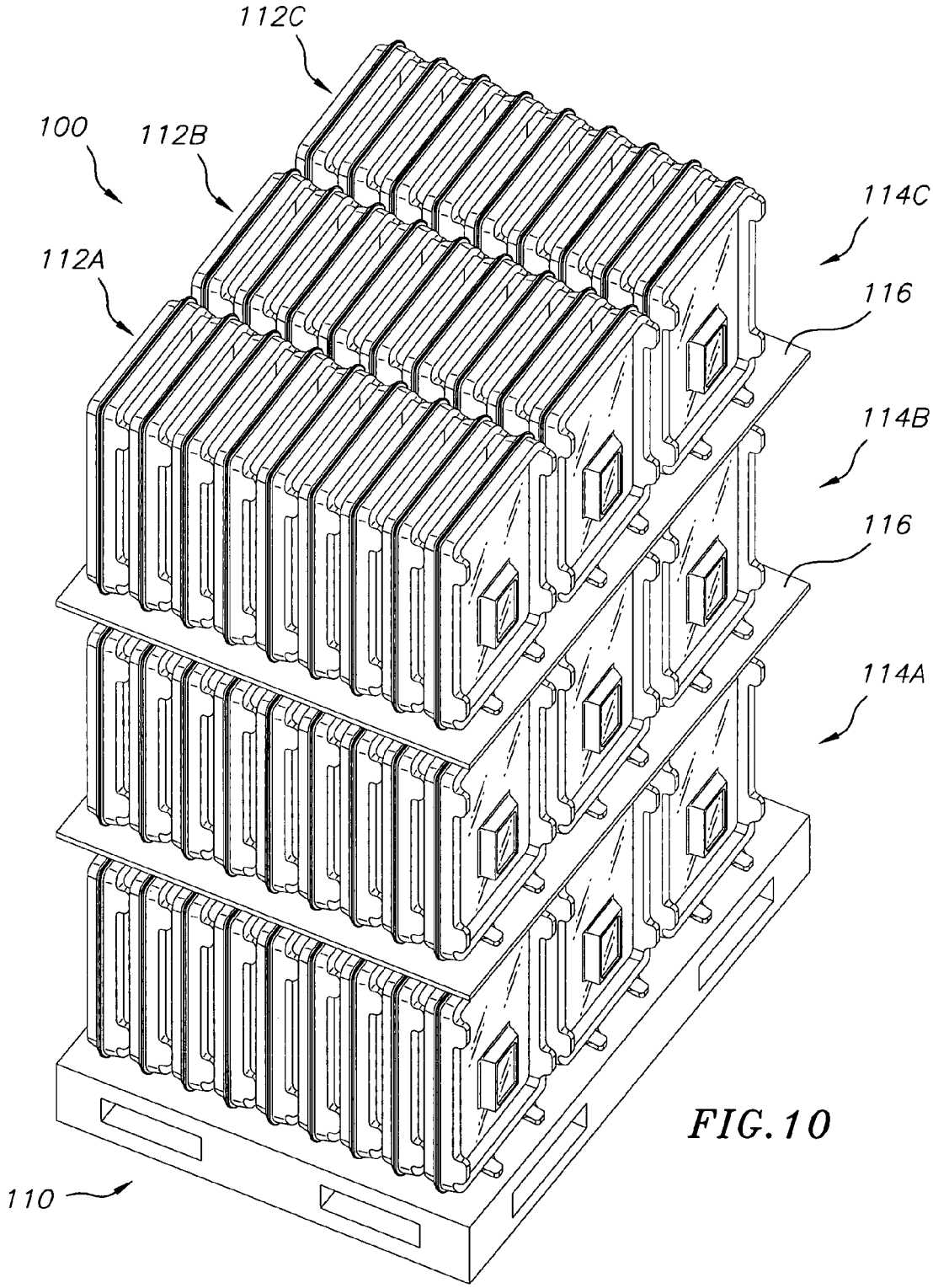
FIG. 10 is an isometric view showing groups of interconnected display packages positioned on a pallet.

FIG. 7 is a cross-section view along view lines 7—7 of the closed exemplary display package 10 of FIG. 1 with first display package portion 12 and second display package portion 42 aligned with the first interface region 28 fitted together with second interface region 56, with inner surfaces of rear wall 16 and front wall facing each other. First cavity portion 14 and second cavity portion 44 will thus form combined cavity portion 60 for retention of an article 90 therein. First display package portion 12 and second display package portion 42 can thus be sealed closed together along their first interface region 28 and second interface region 56 to secure articles 90 within combined cavity 60. As shown, first engagement means 20 and second engagement means 50 will thus be aligned so that a plurality of display packages can be interconnected, as shown in FIGS. 8 and 10. Moreover, cavity 60 can be located at different positions within the perimeter of the display package.

Turning to FIG. 8, a pair of display packages 10A and 10B are shown in their interconnected mode, with first engagement means 20A of display package 10A interconnecting with second engagement means 50A of display package 10B. The first and second engagement means 20A and 50A will preferably interference fit together, and require both a slight force to connect and disconnect display packages 10A and 10B. As can be seen, tabs 30 extending from first package portion 12 will be sized such that when first and second engagement means 20 and 50 engage, tabs 30 will be close to or make contact with upper edge 54 of side wall 52 of second package portion 42. A space 100 will remain between where tabs 30 are not adjacent to upper edge 54 of side wall 52. Since the space 100 is formed between adjacent display packages 10A and 10B, the space 100 will permit vendors and shoppers to easily identify the number display packages selected. Space 100 will also provide an area where an individual can easily slip his or her finger in to pull apart display packages. In addition to establishing spaces 100, tabs 30 will help to stabilize adjacently connected display packages since they limit the degree to which display packages spring back and forth can as a display package be removed from another display package or group of display packages (e.g. on a pallet) and thereby help prevent a group of display packages from unintentionally separating on a pallet. Feet 30 and 62 further act to stabilize a single display package 10 or groups of display packages from tipping over when placed on a surface, such as on a pallet or display location. (See FIG. 10). Feet 30 and 62 can optionally be arranged such that feet 62 fit between feet 30. Although as shown, walls 16 and 46 are close together, these walls could be spaced apart to create additional space, e.g. to receive additional materials (e.g. literature, backing, etc.)

Figure 9B:
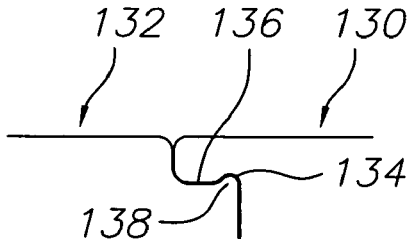
FIGS. 9B and 9C are details showing embodiments of engagement means.
Figure 9C:
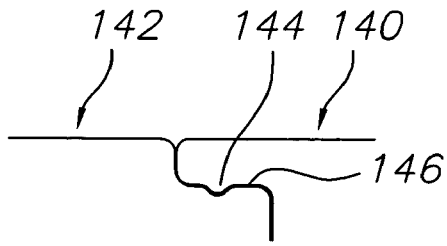
Figure 9A:
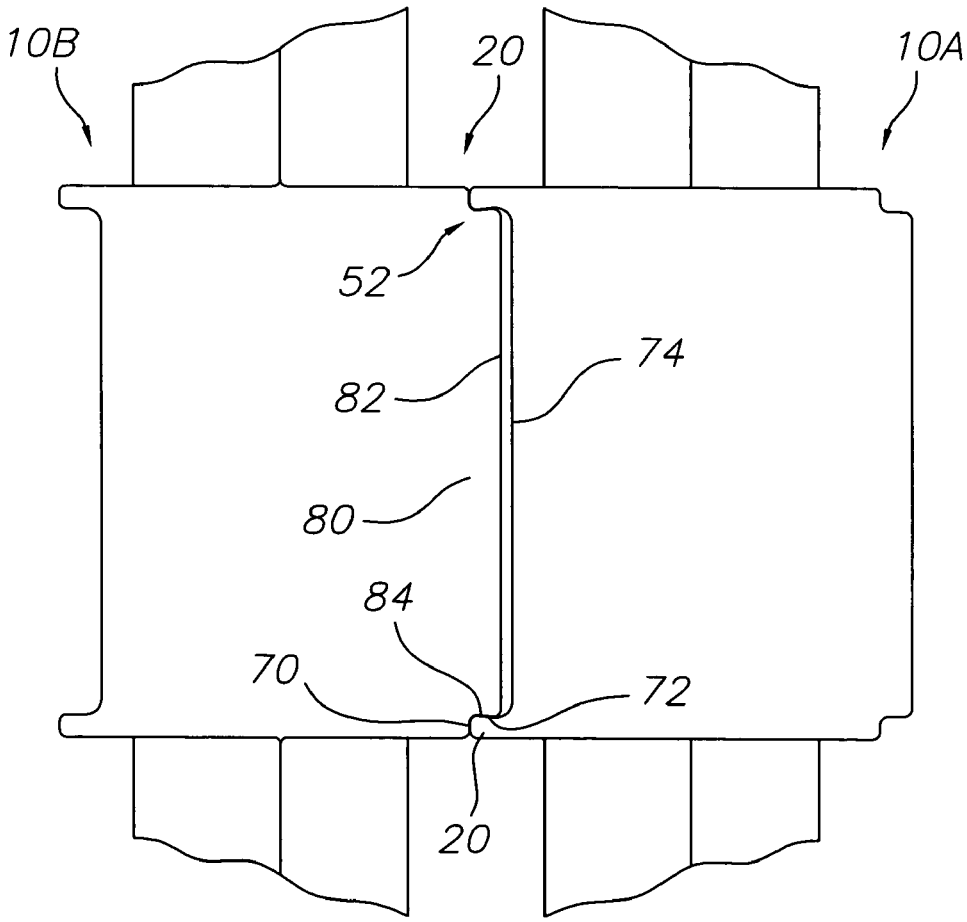
FIG. 9A is a detail of FIG. 8.

FIG. 9A is a detail showing the exemplary interconnection between display packages 10A and 10B of FIG. 8, and shows first engagement means 20 as comprising a lip 20 with an upper edge 70 and an inside surface 72. Surrounded by lip 20 is a lower surface 74 which is below upper edge 72 of lip 20. At least portions of inside surface 72 can be slanted inwardly. Second engagement means 52 can comprise a raised area 80 with an upper wall 82 and upper rim 84. At least portions of upper rim 84 can be slanted outwardly.

FIG. 9B is a detail showing another exemplary embodiment of a first engagement means 130 and second engagement means 132, with the first engagement means 130 having a groove or dimples 134 in the inside wall 136, with second engagement means 132 having a protrusion (e.g. a bead) 138 that fits into groove or dimples 134 to establish an interference fit when first and second engagement means 130 and 132, respectively, are connected together.

FIG. 9C is a detail showing another exemplary embodiment of a first engagement means 140 and second engagement means 142, with the first engagement means 140 having protrusion (e.g. a bead) 144 on the inside wall 146, with second engagement means 142 having a groove or dimples 144 to establish an interference fit when first and second engagement means 140 and 142, respectively, are connected together.

While the display package is shown with the first package portion 12 and the second package portion 42 as separate pieces, they can be hingeably joined together with a living hinge to provide for a unitary structure that can be made as a separate if desired (not shown). Other designs for the first and second engagement means can be used to establish a tight fit between first cavity portion and second cavity portion. For example, while the embodiments show the first engagement means and the second engagement means as being formed substantially around an upper perimeter of the first and second cavity portions, the first and second engagement means can be formed on just portions of the first and second cavity portions, respectively.

FIG. 10 is a perspective view of a plurality of display packages on a pallet 110 ready for display. This view shows three columns 112A, 112B and 112C of display packages 10 forming layers 114A, 114B and 114C on pallet 110. The layers 114A, 114B and 114C can be separated by sheet material 116 (e.g. corrugated cardboard.) Goods shipped on pallets are often wrapped with plastic film for shipment 6 (not shown), which can be easily removed. This immediately readies the pallet of display packed articles 100 to be displayed and sold. Because of the engagement feature and the optional stabilizing feet feature, the display packages 10 will remain in their upright position with additional supports.

Although the first engagement elements and second engagement elements have been described as protrusions and recesses, respectively, other types of engagement elements can be used. Moreover, if desired, the placement of the first and second engagement means and the first and second interface regions can be switched between the first and second package portions.

Although the invention has been shown and presented herein by means of certain embodiments of the display packages and shipping and display systems, it is to be understood that the invention is not limited thereto but may be variously embodied within the spirit and scope of the invention. Those of ordinary skill in the art will be able to identify various modifications which still remain within the ambit of the claims which follow.

What is claimed is:

1. Interconnectable display packages for merchandising articles of commerce, comprising:

a first package portion having side walls with tabs which extend outwardly above a top edge of the side walls, a first interface region around the side walls, and a back wall from which extends a first cavity portion, the first cavity portion having a first engagement means;

a second package portion having side walls, a second interface region around the side walls, and a front wall from which extends a second cavity portion, the second cavity portion having a second engagement means formed thereon, wherein the first package portion is adapted to fit together with the second package portion with the first interface region interfacing with the second interface region, wherein the first and second cavity portions form a combined cavity portion, and wherein the first engagement means of the first package portion of one display package is adapted to engage with the second engagement means of the second package portion of another display package, with the tabs of one display package being located next to the side walls of an adjacent display package, thereby forming a space between the adjacent display packages.

2. The interconnectable display package of claim 1, further comprising at least one stabilizing foot portion on a bottom side of at least one of the first and second package portions.

3. The interconnectable display package of claim 2, wherein the feet extend beyond the side walls of their respective first and second package portions.

4. The interconnectable display package of claim 1, wherein the first engagement means is integrally formed with the first cavity portion and comprises one of a recess and a protrusion, and the second engagement means is integrally formed with the second cavity portion and comprises the other of a recess and a protrusion, wherein the recess and protrusion will interconnect and interface together.

5. The interconnectable display package of claim 1, wherein the first interface region comprises a first ridge and a channel and the second interface region comprises a second ridge and a shelf, the first ridge being dimensioned to fit on the shelf.

6. The interconnectable display package of claim 1, wherein the first portion and the second portion are separate pieces.

* * * * *